United States Patent [19]

Keane et al.

[11] Patent Number: 4,658,465

[45] Date of Patent: Apr. 21, 1987

[54] QUICK RELEASE POWER CORD WRAP FOR CANISTER VACUUM CLEANER

[75] Inventors: James W. Keane, White Bear Lake, Minn.; William J. Martin, Watervliet, Mich.

[73] Assignee: Whirlpool Corporation, Benton Harbor, Mich.

[21] Appl. No.: 742,712

[22] Filed: Jun. 7, 1985

[51] Int. Cl.[4] ..... A47L 9/00

[52] U.S. Cl. ..... 15/323; 15/327 E; 191/12 R; 242/85.1

[58] Field of Search ..... 15/323, 327 R, 327 E; 24/230.5; 191/12 R; 242/85.1

[56] References Cited

U.S. PATENT DOCUMENTS

| | | | |
|---|---|---|---|
| 1,918,713 | 7/1933 | Ponselle . | |
| 2,003,147 | 5/1935 | Hansen | 242/85 |
| 2,037,668 | 4/1936 | Smith et al. | 242/85 |
| 2,156,467 | 5/1939 | Walter | 242/85 |
| 2,192,989 | 3/1940 | Smellie | 242/85 |
| 2,291,353 | 7/1942 | Seyfried | 15/327 E X |
| 2,683,888 | 7/1954 | Ripple | 15/323 |
| 2,693,001 | 11/1954 | Vance | 15/323 |
| 2,876,479 | 3/1959 | Kaufman | 15/323 |
| 2,974,343 | 3/1961 | Seyfried | 15/323 |
| 3,062,430 | 12/1977 | Momberg | 191/12 R |

FOREIGN PATENT DOCUMENTS

| | | | |
|---|---|---|---|
| 244023 | 9/1947 | Switzerland | 15/323 |

*Primary Examiner*—Chris K. Moore

*Attorney, Agent, or Firm*—Wood, Dalton, Phillip, Mason & Rowe

[57] ABSTRACT

A quick release power cord wrap and caster for a canister vacuum cleaner. The caster assembly includes a hook for supporting or retaining a plurality of power cord turns is stored position on the canister. A hook is movable to release the cord and, in the illustrated embodiment, the hook is pivotable on the caster. The hook has a toggle action for locking the power cord in the stored arrangement. In addition, the hook and canister body are provided with shoulders for providing an augmented locking of the hook in the cord stored position. The caster assembly and canister body are arranged to permit snap-fastening of the caster assembly to the canister body without need for separate metal fasteners and the like. The caster assembly itself is arranged to have the portions thereof snap-fastened together without the use of separate metal fasteners.

21 Claims, 6 Drawing Figures

FIG. 1
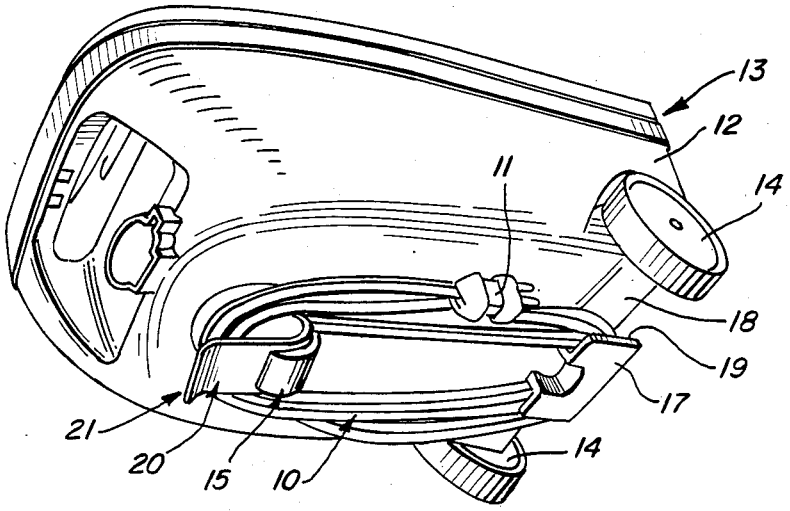
FIG. 2
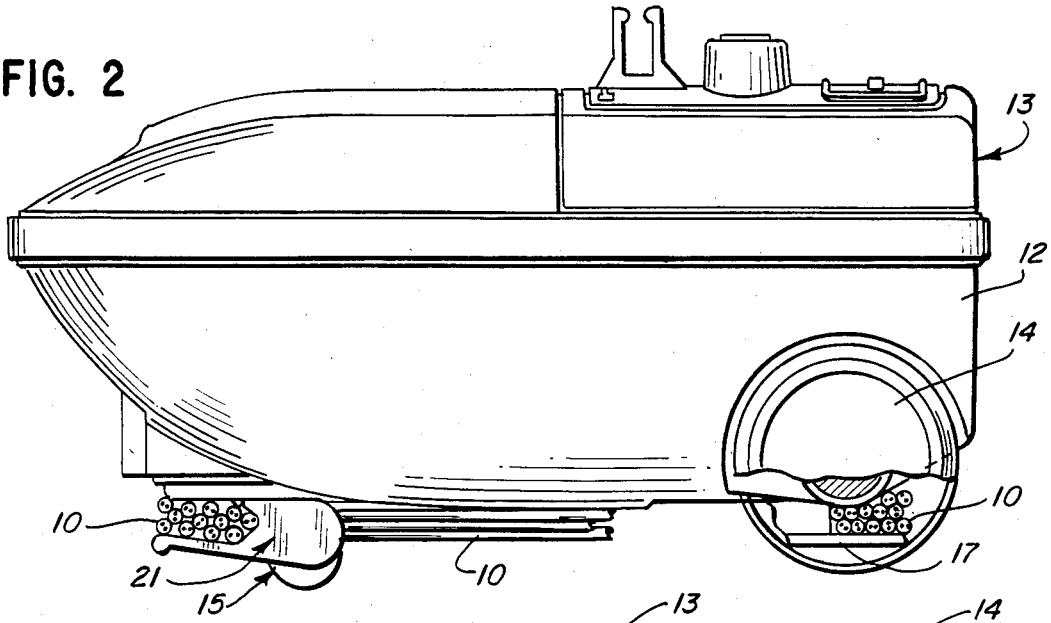
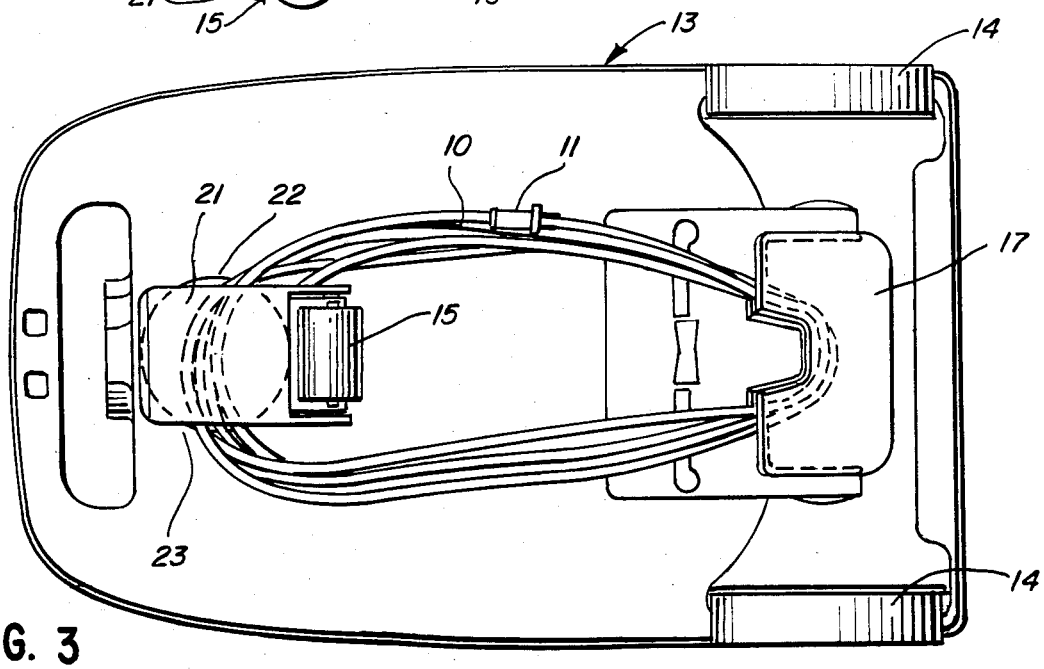
FIG. 3

FIG. 4
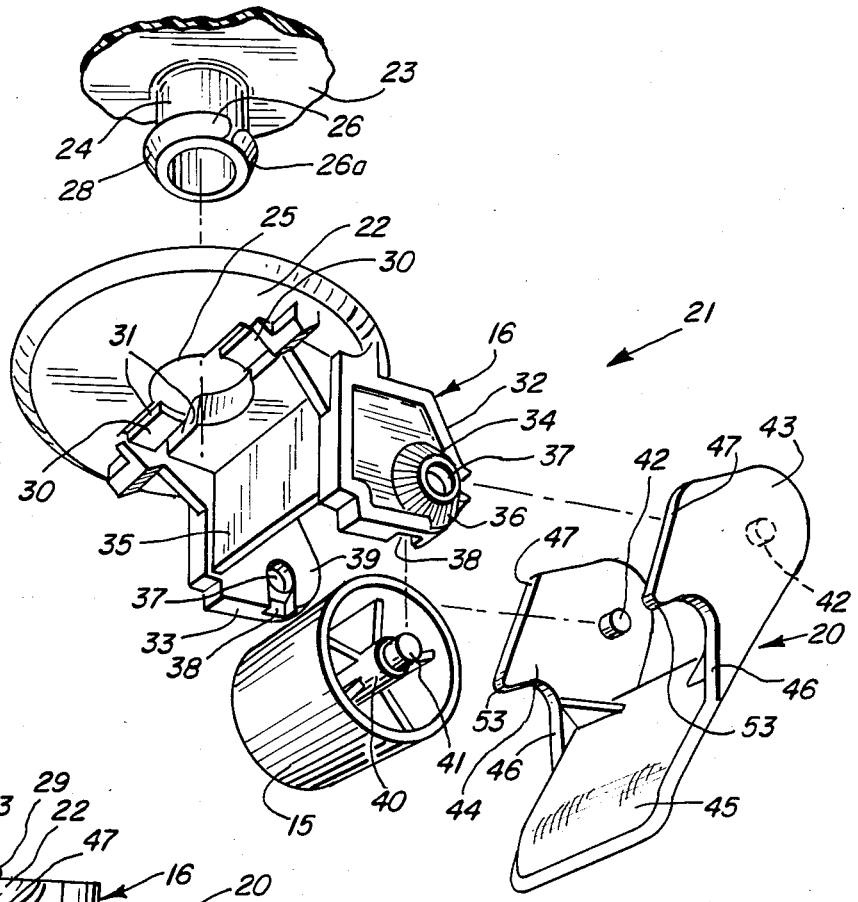
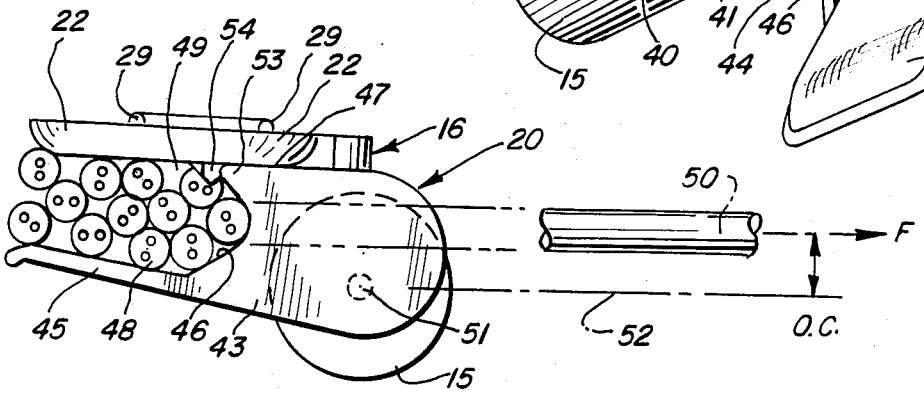
FIG. 5
FIG. 6
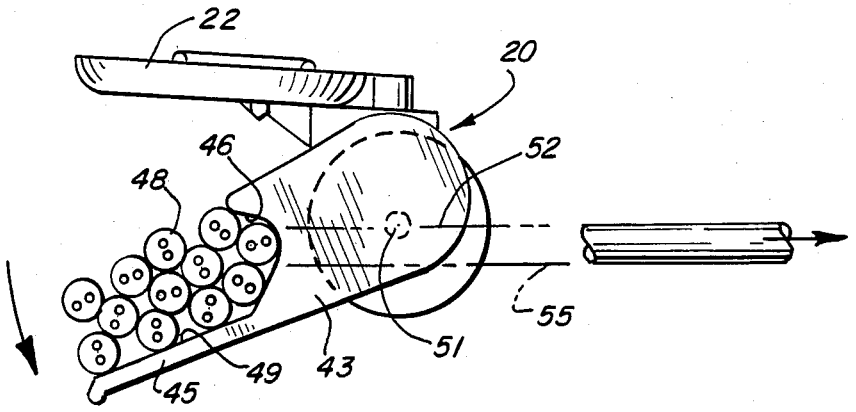

QUICK RELEASE POWER CORD WRAP FOR CANISTER VACUUM CLEANER

TECHNICAL FIELD

This invention relates to vacuum cleaners and in particular to means for storing the power cord of a canister vacuum cleaner.

BACKGROUND ART

It is conventional in canister vacuum cleaner apparatuses to provide means for storing the power cord within the body of the canister, such as by use of a spring-actuated retractable cord reel device.

In U.S. Pat. No. 2,974,343, Arthur W. Seyfried discloses a canister-type vacuum cleaner wherein the bottom of the canister is provided with means for mounting the power cord thereon. Thus, when the canister is stored on its side, the bottom may be disposed so as to be rearwardly facing so that the cord is concealed from anyone viewing the front or sides of the canister in the stored disposition. In storing the cord, it is looped back and forth in the hands of the user and the looped cord is then placed behind a hinged plate which is temporarily swung to an open position away from the canister bottom. A portion of the looped cord is inserted behind a fixed arm defining, with the bottom of the canister, a cord-receiving recess which is subsequently further closed by the hinged plate.

In U.S. Pat. No. 2,683,888 of Melvin H. Ripple, the canister is provided with front and rear skids, permitting the cord to be wrapped around the skids in an exposed disposition in the stored arrangement.

It is further conventional in upright vacuum cleaners to provide spaced hooks on the manipulating handle about which the cord is wrapped when the vacuum cleaner is stored.

DISCLOSURE OF INVENTION

The present invention comprehends an improved quick-release power cord wrap for use with a canister-type vacuum cleaner wherein a portion of the cord supporting means is mounted to one of the wheels providing a wheeled support of the canister.

In the illustrated embodiment, the cord supporting wheel comprises a caster pivotally mounted to the canister body.

The caster wheel and cord wrap device, in the illustrated embodiment, comprises three parts snap-fitted together, including a caster frame, a caster wheel, and a cord wrap element.

The cord wrap element is movably mounted to the frame so as to be selectively positionable in an open position for accepting the cord during the wrapping operation, and an overcentered, closed position whereby the cord wrap element provides automatic self-locking of the cord wrap in the cord-storing disposition.

The cord wrap element and a portion of the frame are provided with cooperating shoulders which provide further locking of the cord wrap element in the cord-storing disposition.

The entire caster, including the cord wrap, is mounted to the body of the canister in snap-fitting relationship, avoiding the need for metal fasteners and the like.

Thus, the invention comprehends the provision in an electrically operable appliance having a housing, first support means on the housing, and a flexible electrical power cord extending outwardly from the housing for use in providing electrical power to the appliance, of an improved means for storing the power cord when the appliance is not in use. The power cord storing means of the present invention includes a second support wheel means on the housing for cooperation with the first support wheel means for providing a wheeled support of the appliance in use. A first cord wrap support means is provided on the housing and a second cord wrap support means is provided on the second support wheel means. The first and second cord wrap support means cooperatively define means for retaining the power cord wrapped thereabout when the appliance is not in use.

The second support wheel means defines a frame movably mounted to the housing. The frame defines a pair of spaced wheel mounts having opposited, aligned openings. The wheel has oppositely projecting axles received one each in the openings. The cord wrap support means defines opposed pivot portions pivotally received one each in the wheel axle openings outwardly of the axles.

The invention comprehends the provision of means for mounting the caster wheel to a mounting post provided on the appliance housing. The mounting means includes a frame having an opening defining an axle for coaxially receiving the mounting post, annular wall means upstanding from the frame adjacent the opening for slidably engaging the housing circumjacent the mounting post, at least one tongue resiliently cantilevered from the frame toward the opening having a distal end defining a portion of the opening, and annular retaining boss segments on the post interlocking with the frame circumjacent the opening. Means are provided for rotatably mounting the caster wheel to the frame to be spaced from the opening axis.

In the illustrated embodiment, the second cord wrap support means comprises an L-shaped cord retainer having a pair of first legs mounted to the mounting frame for pivoting about a pivot axis and a second leg defining with the first leg a cord-receiving recess opening away from the first cord wrap support means. The cord retainer is selectively pivotally positionable in a cord-retaining position wherein a line from the recess to the first cord retaining means lies between the pivot axis and the housing, and in a cord-transfer position wherein the line through the pivot axis to the first cord retaining means lies between the recess and the housing.

The cord wrap retaining means of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a bottom perspective view of a vacuum cleaner canister having a cord wrap embodying the invention;

FIG. 2 is a side elevation with a portion of the canister broken away;

FIG. 3 is a bottom plan view thereof;

FIG. 4 is a fragmentary exploded perspective view illustrating the elements of the caster wheel-cord wrap element;

FIG. 5 is a fragmentary side elevation illustrating the arrangement of the cord in the cord-retained disposition on the caster-cord wrap element; and FIG. 6 is a view similar to FIG. 5, but showing the arrangement of the cord wrap element in the open, cord wrap receiving disposition.

BEST MODE FOR CARRYING OUT THE INVENTION

In the illustrative embodiment of the invention as disclosed in the drawing, a power cord generally designated 10 comprises a conventional flexible multiconductor power cord having a plug 11 adapted to be connected to the conventional domestic 110-volt AC power supply receptacles. The cord extends outwardly from the body 12 of a canister generally designated 13 of a canister-type vacuum cleaner.

The canister 13 includes a conventional electrically-energizable motor-blower assembly (not shown) which is energized through power cord 10, and is supported for wheeled movement over a subjacent floor surface by means of rear wheels 14 and a front wheel 15. In the illustrated embodiment, front wheel 15 comprises a caster roller rotatably mounted in a frame 16.

Canister 12 is provided with a first cord wrap support 17 on a bottom wall portion 18 of the canister body. As seen in FIG. 1, cord wrap support 17 is disposed intermediate the rear wheels 14 and defines a rearwardly opening cord wrap recess 19 in which the wrap turns of power cord 10 are received when the power cord is wrapped in the storage disposition of FIG. 1.

A second cord wrap support 20 is mounted to frame 16 to define, with the caster wheel 15, a caster wheel-cord wrap support element generally designated 21.

More specifically, as seen in FIG. 4, frame 16 includes a baseplate 22 adapted to be mounted subjacent the bottom surface portion 23 of the canister body, on a depending mounting post 24 formed integrally with the canister body portion 23. As seen in FIG. 4, the mounting plate defines a through bore 25. Post 24 is provided at its distal lower end with an outturned flange 26 having opposed shoulders or bumps **26*a*, for securing baseplate 22 to post 24 as will appear. The post 24 and baseplate 22 are sized and constructed so as to permit flange 26 to pass downwardly through opening 25 of mounting plate 22 in mounting the frame 16 to the post 24. To facilitate the movement of the post downwardly through opening 25, flange 26 and shoulders 26*a* are provided with outer, downwardly narrowing, somewhat frustoconical surfaces 28**.

As illustrated in FIG. 5, the mounting plate 22 is provided with a pair of upstanding, arcuate walls 29. The walls 29 define slide means for slidably engaging the canister body portion 23 in supporting the front end of the canister on the front caster wheel 15.

Mounting plate 22 further defines a pair of radially inwardly cantilevered tongues 30 defined by parallel slots 31 extending outwardly from bore 25 at diametrically opposite sides of the bore, as shown in FIG. 4. Tongues 30 define resilient tab elements cooperating with the flange 26 and shoulders **26*a* in removably securing the frame 16 to the mounting post 24** without the need for metal fasteners and the like.

As further illustrated in FIG. 4, frame 16 includes a pair of support walls 32 and 33 defining journals 34. A transverse reinforcing wall 35 extends between the support walls. The entire frame, as shown in FIG. 4, comprises a one-piece element which may be molded of synthetic resin or the like for low cost, high strength manufacture.

Each of the journals 34 includes an outwardly projecting frustoconical boss 36 defining a through bore 37. A slot 38 opens downwardly from bore 37 on the inner surface 39 on each support wall. Caster wheel 15 is provided with an integral hub portion 40 having outwardly extending distal axle portions 41 adapted to be passed upwardly through the slots 38 into alignment with bores 37. The support walls have sufficient resiliency to expand away from each other sufficiently to permit the movement of the axle 41 through the slots into coaxial relationship with the bores 37, whereupon the support walls 32 and 33 may spring back to the normal disposition, with the axles 41 effectively retained in the journals 34 for free rotative movement of the caster wheel 15 on the frame.

In the illustrated embodiment, the slots 38 define inclined ramp surfaces so as to facilitate the sliding movement of the axles 41 upwardly therethrough into alignment with the bores 37, as discussed above.

The axial length of the bores 37 is more than the length of axles 41 and, in the illustrated embodiment, is approximately twice the length of the axles 41, so that the outer portion of bores 37 may receive a pair of pivots 42 on the second cord wrap support 20. As shown in FIG. 4, the pivots 42 are carried on a pair of upright sidewalls 43 and 44 defining, with a cord support wall 45, a generally L-shaped cord retainer. The sidewalls define U-shaped front edges 46 which form a hook for retaining the power cord turns. The edges 46 terminate at their upper ends in generally rectilinear upper surfaces 47 on the sidewalls 43 and 44 defining mounting legs of the second cord wrap support 20.

Pivots 42 are guided into the outer portions of the bores 37 by the frustoconical surface of the journals 34 so that when they are brought into alignment with the bore 37, resiliency of the spaced legs 43 and 44 urges them into the outer end of the bore outwardly of the axles 41. Thus, the journals 34 serve both as the journaling means for the caster wheel and the pivot means for the cord wrap support 20.

The functioning of the second cord wrap support 20 is best seen with reference to FIGS. 5 and 6. In the normal cord-retaining dispoition shown in FIG. 5, the turns 48 of the cord 10 are received in the recess 49 defined by the cord support wall 45, the baseplate 22, and the hook provided by the U-shaped front edges 46 of the legs 43 and 44. In the cord-retaining position of FIG. 5, a line, such as line 50, extending from the recess 49 to the first cord-retaining means 17 at the rear of the canister body, lies between the pivot axis 51 of the pivots 42 and bores 37, and the bottom wall of the canister body 12, and more specifically, the bottom surface of the baseplate 22 of frame 16. In this arrangement, the cord support wall 45 is overcentered relative to a line 52 between the axis 51 and the rear cord support 17 to provide a toggle action, whereby the wrapped cord tends to lock the second cord wrap support 20 in the cord-retaining disposition of FIG. 5.

As further illustrated in FIG. 5, the juncture between the front surfaces 46 and top surfaces 47 of the legs 43 and 44 defines a projecting shoulder 53. As shown in FIG. 5, shoulder 53 engages a depending locking shoulder 54 on the baseplate 22, with the engagement therebetween serving to define a second locking means in retaining the second cord wrap support 20 in the cord-retaining disposition of FIG. 5.

To permit unwrapping the cord from the cord wrap supports when it is intended to place the vacuum cleaner in use, or when it is desired to wrap the cord about the cord wrap supports after use of the vacuum cleaner, the second cord wrap support 20 is swung to a cord wrap disposition, as illustrated in FIG. 6, wherein the recess 49 is swung away from the baseplate 22 to below the line 52, thereby bringing the recess 49 somewhat closer to the rear cord support 17 and permitting facilitated unwrapping or wrapping of the cord relative to the recess 49. Thus, in this disposition, the line 52 lies between the canister or baseplate 22, and the line 55 extending from the repositioned recess 49 to the rear cord support 17.

Thus, the positions illustrated in FIGS. 5 and 6 represent overcenter positions relative to a position of the recess wherein the recess is aligned through the axis 51, with the rear support 17. Thus, the second cord wrap support 20 tends to remain in the open position during the cord wrap or cord unwrapping operations facilitating such operations, while yet the second cord wrap support may be readily pivoted to the retaining disposition of FIG. 5 by simply pressing upwardly on the first support wall 45 to bring the recess 49 with the cord wrap turns 48 therein to the retaining disposition of FIG. 5 wherein it is retained by the overcentered arrangement and the locking means 53,54 discussed above.

The concave surfaces 46 of the legs 43 and 44 define the force transfer surfaces between the cord wrap and the pivotable second cord wrap support 20 and are preselected to effect the desired wrap retaining functioning, as shown.

As further illustrated in FIG. 5, in the cord-retaining disposition, the rectilinear surfaces 47 of the legs 43 and 44 bear against the underside of the baseplate 22 so as to provide a limit to the pivotal movement of the second cord wrap support to the desired retaining disposition illustration in FIG. 5.

Each of the three elements of the wheel-wrap device 21 is interlocked with the other elements so that the assembly thereof is effected without the need for metal fasteners and the like. Each of the elements of the disclosed structure may be formed as by molding of synthetic resin and, thus, the cord wrap means of the present invention is extremely simple and economical of construction while yet providing highly improved cord wrap retaining functioning discussed above.

The foregoing disclosure of specific embodiments is illustrative of the broad inventive concepts comprehended by the invention.

We claim:

1. In an electrically operable appliance having a housing, first wheel means on the housing, and a flexible electrical power cord extending outwardly from the housing for use in providing electrical power to the appliance, the improvement comprising:

second wheel means on the housing for cooperation with said first wheel means for providing a wheeled support of said appliance in use;

means on the housing defining a first cord wrap support; and second means on said second wheel means defining a second cord wrap support, said first and second cord wrap supports cooperatively defining oppositely outwardly facing surfaces about which said power cord may be wrapped for removably retaining said power cord in a stored condition when said appliance is not in use.

2. In an electrically operable appliance having a housing, first wheel means on the housing, and a flexible electrical power cord extending outwardly from the housing for use in providing electrical power to the appliance, the improvement comprising;

second wheel means on the housing for cooperation with said first wheel means for providing a wheeled support of said appliance in use;

means on the housing defining a first cord wrap support; and second means on said second wheel means defining a second cord wrap support, said first and second cord wrap supports cooperatively defining means for removably retaining said power cord in a stored condition when said appliance is not in use, said housing and said second wheel means defining integral snap-fitted interconnection means for providing maintained assembly thereof.

3. The electrically operable appliance structure of claim 1 wherein said first cord wrap support is fixedly mounted to said housing.

4. The electrically operable appliance structure of claim 1 wherein said first cord wrap support is fixedly mounted to said housing adjacent said first wheel means.

5. In an electrically operable appliance having a housing, first wheel means on the housing, and a flexible electrical power cord extending outwardly from the housing for use in providing electrical power to the appliance, the improvement comprising;

second wheel means on the housing for cooperation with said first wheel means for providing a wheeled support of said appliance in use;

means on the housing defining a first cord wrap support; and second means on said second wheel means defining a second cord wrap support, said first and second cord wrap supports cooperatively defining means for removably retaining said power cord in a stored condition when said appliance is not in use, further including means for positioning said second cord wrap support on said second wheel means selectively in a first, cord transfer position and a second, cord wrap retaining position.

6. The electrically operable appliance structure of claim 5 further including means for releasably retaining the second cord wrap support in said second position.

7. The electrically operable appliance structure of claim 5 wherein said means for releasably retaining the second cord wrap support in said second position comprises cooperating releasably locking means on said housing and second cord wrap support.

8. The electrically operable appliance structure of claim 5 wherein said means for releasably retaining the second cord wrap support in said second position comprises means for selectively disposing said second cord wrap support in an overcenter disposition.

9. In an electrically operable appliance having a housing, first wheel means on the housing, and a flexible electrical power cord extending outwardly from the housing for use in providing electrical power to the appliance, the improvement comprising;

second wheel means on the housing for cooperation with said first wheel means for providing a wheeled support of said appliance in use;

means on the housing defining a first cord wrap support; and second means on said second wheel means defining a second cord wrap support, said first and second cord wrap supports cooperatively defining means for removably retaining said power cord in a stored condition when said appliance is not in use, said second cord wrap support being pivotally mounted to said second wheel means.

10. In an electrically operable appliance having a housing, first wheel means on the housing, and a flexible electrical power cord extending outwardly from the housing for use in providing electrical power to the appliance, the improvement comprising:

second wheel means on the housing for cooperation with said first wheel means for providing a wheeled support of said appliance in use, said second wheel means defining a frame movably mounted to said housing and defining a pair of spaced wheel mounts having opposed aligned openings and a wheel having oppositely projecting axles received one each in said openings;

means on the housing defining a first cord wrap support; and means on said second wheel means defining a second cord wrap support, said first and second cord wrap support cooperatively defining means for retaining said power cord wrapped thereabout when said appliance is not in use, said second cord wrap support defining opposed pivot portions pivotally received one each in said openings outwardly of said axles.

11. The electrically operable appliance structure of claim 10 wherein said second wheel means defines guide surface means for guiding said wheel axles into said openings during assembly of the wheel to the spaced wheel mounts.

12. The electrically operable appliance structure of claim 10 wherein said second wheel means defines guide slot means for guiding said wheel axles into said openings during assembly of the wheel to the spaced wheel mounts.

13. The electrically operable appliance structure of claim 10 wherein said second wheel means defines guide means for guiding said pivot portions of the second cord wrap support into said openings during assembly of the second cord wrap support to said frame.

14. The electrically operable appliance structure of claim 10 wherein said second wheel means defines a frustoconical guide surface concentrically of each opening for guiding said pivot portions of the second cord wrap support into said openings during assembly of the second cord wrap support to said frame.

15. In an electrically operable appliance having a housing, first wheel means on the housing, and a flexible electrical power cord extending outwardly from the housing for use in providing electrical power to the appliance, the improvement comprising:

second wheel means on the housing for cooperation with said first wheel means for providing a wheeled support of said appliance in use, said second wheel means defining a mounting frame;

means on the housing defining a first cord wrap support; and means on said second wheel means defining a second cord wrap support, said first and second cord wrap supports cooperatively defining means for retaining said power cord wrapped thereabout when said appliance is not in use, said second cord wrap support comprising an L-shaped cord retainer having a pair of first legs mounted to said mounting frame for pivoting about a pivot axis, and a second leg defining with said first legs a cord-receiving recess opening away from said firs cord wrap support means, said cord retainer being selectively pivotally positionable in a cord-retaining position wherein a line from said recess to said first cord-retaining means lies between said pivot axis and said housing, and in a cord transfer position wherein a line through said pivot axis to said first cord-retaining means lies between said recess and said housing.

16. The electrically operable appliance structure of claim 15 wherein said mounting frame defines a wall mounted to said housing for swivelling about a swivel axis, said recess opening toward said wall in said cord-retaining position of said cord retainer whereby a portion of said wall defines a boundary of said recess.

17. The electrically operable appliance structure of claim 15 wherein cooperating means are providing on said mounting frame and cord retainer for releasably locking said cord retainer in said cord-retaining position.

18. The electrically operable appliance structure of claim 15 wherein each of said first legs defines a concave edge defining an end of said recess.

19. The electrically operable appliance structure of claim 15 wherein said second leg defines a turned distal end portion.

20. The electrically operable appliance structure of claim 15 wherein said second support wheel means includes a caster wheel rotatable about a wheel axis coinciding with said cord retainer pivot axis.

21. In an electrically operable appliance having a housing, first wheel means on the housing, and a flexible electrical power cord extending outwardly from the housing for use in providing electrical power to the appliance, the improvement comprising:

second wheel means on the housing for cooperation with said first wheel means for providing a wheeled support of said appliance in use;

means comprising a hook formed on the housing defining a first cord wrap support; and means comprising a pivotable hook formed on said second support wheel means defining a second cord wrap support, said second cord wrap support having a toggle action for locking the power cord in a retained disposition, said first and second cord wrap support means cooperatively defining means for retaining said power cord wrapped thereabout when said appliance is not in use.

* * * * *